US007293649B2

(12) United States Patent
Gelphman et al.

(10) Patent No.: US 7,293,649 B2
(45) Date of Patent: Nov. 13, 2007

(54) COMPUTER BAG WITH CROSS-BRACE SUPPORT

(75) Inventors: Steve Gelphman, Half Moon Bay, CA (US); Scott Croyle, San Francisco, CA (US); Robin Petravic, Sausalito, CA (US); Seth Frankel, Los Angeles, CA (US)

(73) Assignee: ACCO Brands USA LLC, Lincolnshire, IL (US)

( * ) Notice: Subject to any disclaimer, the term of this patent is extended or adjusted under 35 U.S.C. 154(b) by 453 days.

(21) Appl. No.: 10/870,479

(22) Filed: Jun. 16, 2004

(65) Prior Publication Data

US 2005/0258057 A1 Nov. 24, 2005

Related U.S. Application Data

(60) Provisional application No. 60/573,136, filed on May 21, 2004.

(51) Int. Cl.
*B65D 85/30* (2006.01)

(52) U.S. Cl. ..... 206/320; 190/124

(58) Field of Classification Search ..... 190/102, 190/109, 124; 206/320, 583, 591, 592, 594
See application file for complete search history.

(56) References Cited

U.S. PATENT DOCUMENTS

| | | | | |
|---|---|---|---|---|
| 5,524,754 | A * | 6/1996 | Hollingsworth | 206/320 |
| 5,529,184 | A * | 6/1996 | Sadow | 206/320 |
| 5,775,497 | A * | 7/1998 | Krulik | 206/320 |
| 6,105,764 | A * | 8/2000 | Scicluna et al. | 206/320 |
| 6,739,754 | B2 * | 5/2004 | Moor et al. | 383/40 |
| 6,827,185 | B2 * | 12/2004 | Scicluna | 190/110 |
| 6,896,134 | B2 * | 5/2005 | Russell et al. | 206/320 |
| 2002/0125092 | A1 * | 9/2002 | Nykoluk et al. | 190/127 |
| 2004/0134813 | A1 * | 7/2004 | Domotor | 206/320 |

* cited by examiner

*Primary Examiner*—David T. Fidei
(74) *Attorney, Agent, or Firm*—Townsend and Townsend and Crew LLP

(57) ABSTRACT

A carrying case or bag that includes a soft pouch portion that is supported with a more rigid support structure. The soft pouch portion is supported by a cross-brace support system that allows limited movement relative to the support structure.

27 Claims, 3 Drawing Sheets

COMPUTER BAG WITH CROSS-BRACE SUPPORT

CROSS-REFERENCES TO RELATED APPLICATIONS

This application claims priority from co-pending U.S. Provisional Patent Application No. 60/573,136, filed May 21, 2004, entitled "COMPUTER BAG WITH CROSS-BRACE SUPPORT", which is hereby incorporated by reference, as if set forth in full in this document, for all purposes.

The following application is related to the present application and is hereby incorporated by reference in its entirety for all purposes:

U.S. application Ser. No. 10/717,215, filed Nov. 18, 2003, entitled "BAG INCLUDING A CONTOUR PANEL".

BACKGROUND OF THE INVENTION

1. Field of the Invention

The present invention relates to a carrying case that protects items from damage if the carrying case is dropped, and more particularly, to a computer bag that includes a cross-brace support system.

2. Description of the Prior Art

Personal electronic devices such as, for example, notebook computers, portable DVD players, personal digital assistants (PDAs), etc., are common in today's society. People carry one or more of these electronic devices when commuting, traveling, etc. for both business and pleasure. Accordingly, most people carry these devices in carrying cases. These carrying cases generally include a fair amount of padding, insulation and other types of materials in order to protect the item from being damaged in the event that the carrying case is dropped or "banged around". Many of the carrying cases strap the electronic device within the carrying case or secure it in some other type of fashion so that it rigidly secured within the carrying case.

Even with the padding and other types of materials, as well as securing the item within the carrying case, the portable electronic device is still susceptible to damage if the carrying case is dropped or banged around. When the carrying case is dropped, a great deal of energy or shock is created at the point of contact. When electronic devices are secured such that they do not move within the carrying case, the energy or shock of the impact is concentrated at the point of contact and absorbed by the portable device. Accordingly, the electronic device may be severely damaged due to the impact. Thus, an improved carrying case is desirable.

BRIEF SUMMARY OF THE INVENTION

Broadly, the present invention provides a carrying case or bag that includes a soft pouch portion that is supported with a more rigid support structure. The soft pouch portion is supported by a cross-brace support system that allows limited movement relative to the support structure.

Thus, a compartment for a bag for carrying an item in accordance with the present invention includes a main portion and a second portion within the main portion. A support arrangement is provided to support the second portion within the main portion and allows limited movement of the second portion relative to the main portion.

In accordance with one aspect of the present invention, the support arrangement includes two straps, each strap extending from a respective top corner on a first side of the second portion, under the second portion of the compartment and a respective top corner on a second side of the second portion.

In accordance with another aspect of the present invention, a bag for carrying a portable electronic device includes a main body and a device compartment within the main body. The device compartment includes a support structure consisting of a substantially rigid material and a soft pouch within the support structure. A cross brace support system is provided that supports the soft pouch such that the soft pouch has limited movement relative to the support structure. Also, the cross brace support structure dissipates energy from an impact throughout the support structure.

The following detailed description together with the accompanying drawings will provide a better understanding of the nature and advantages of the present invention.

DETAILED DESCRIPTION OF THE INVENTION

Figure 1:
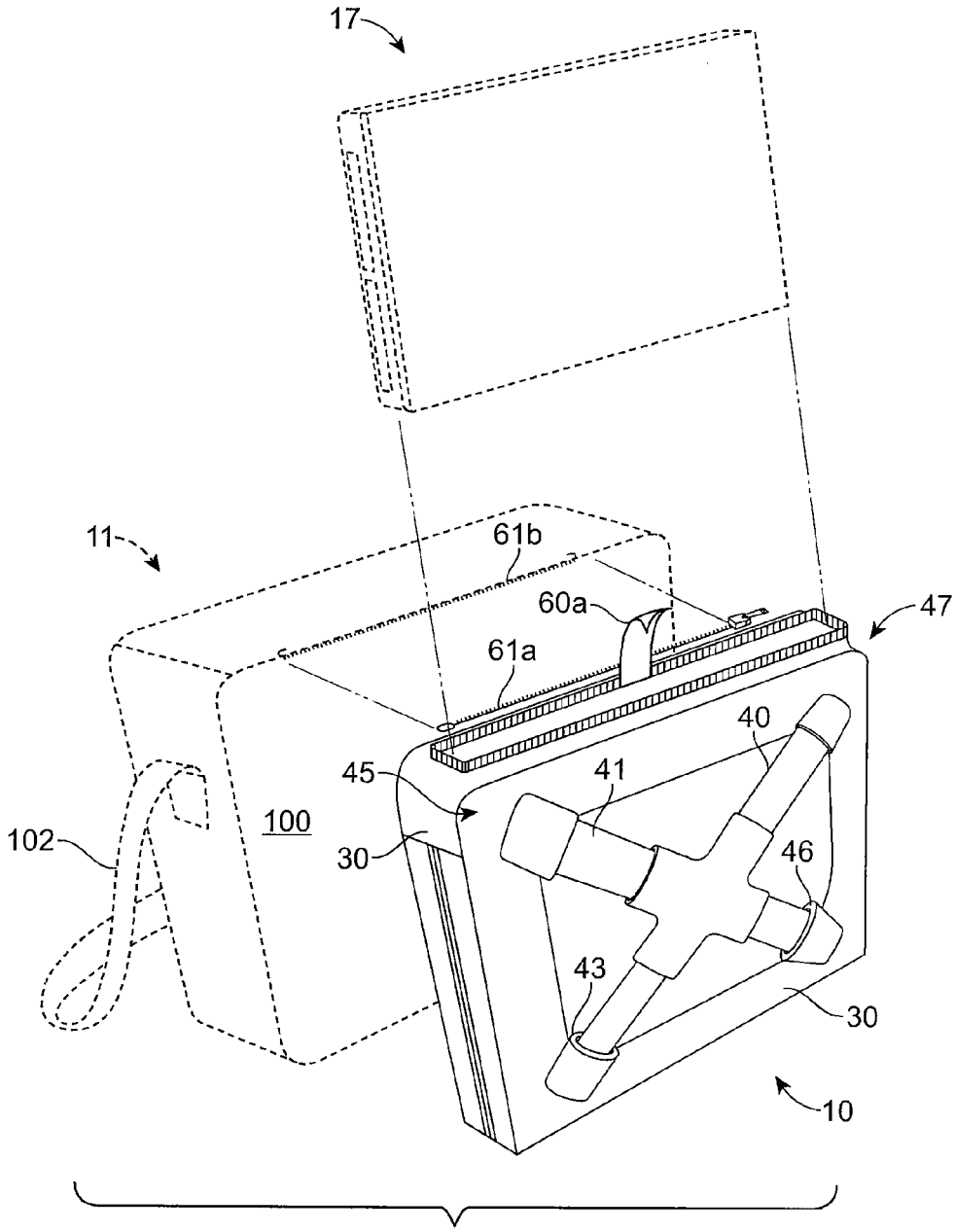
FIG. 1 is a perspective view of a carrying case, including a compartment supported by a cross-brace system in accordance with the present invention.
Figure 2:
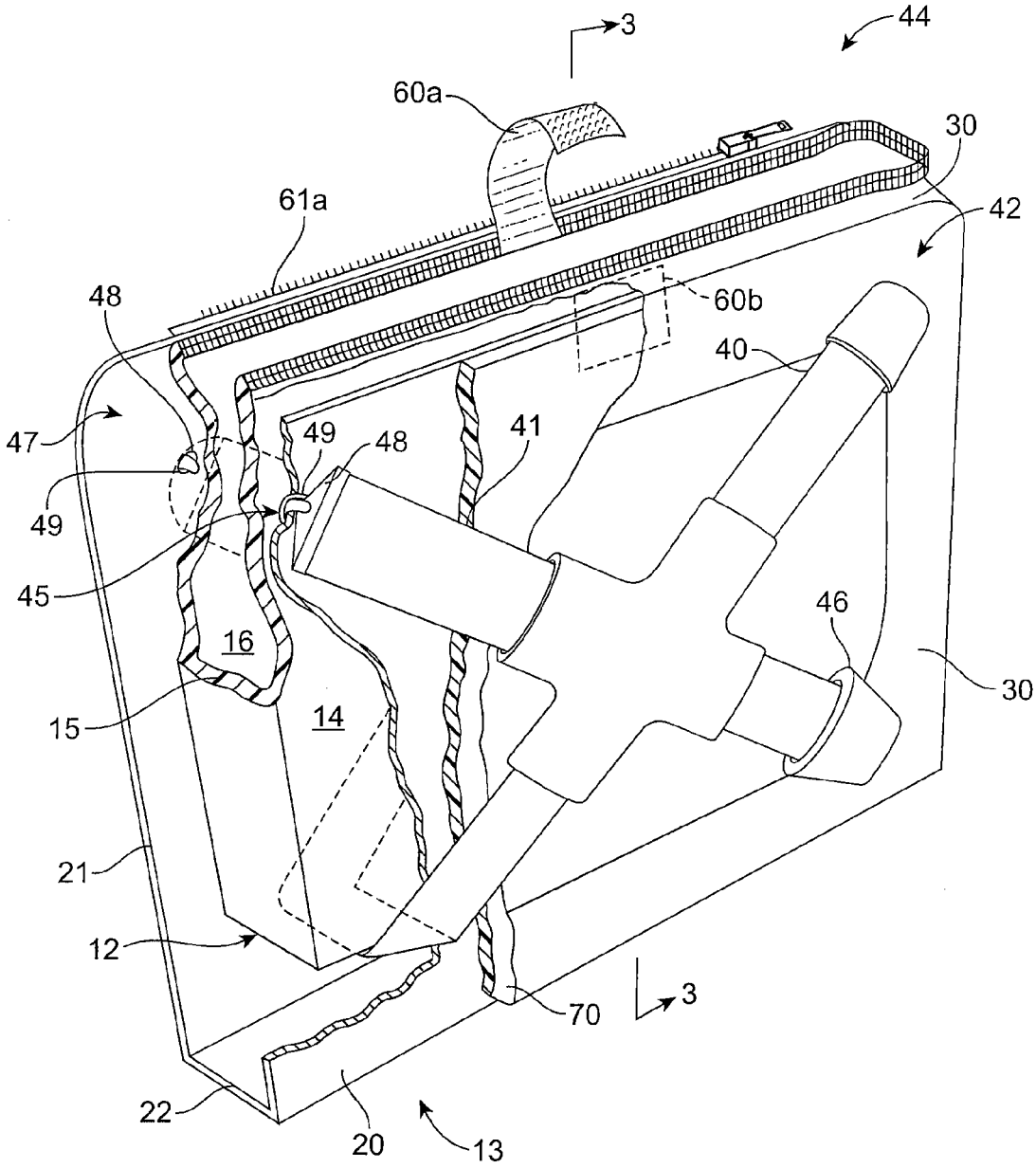
FIG. 2 is a partial sectional view of a compartment supported by a cross-brace system in accordance with the present invention.
Figure 3:
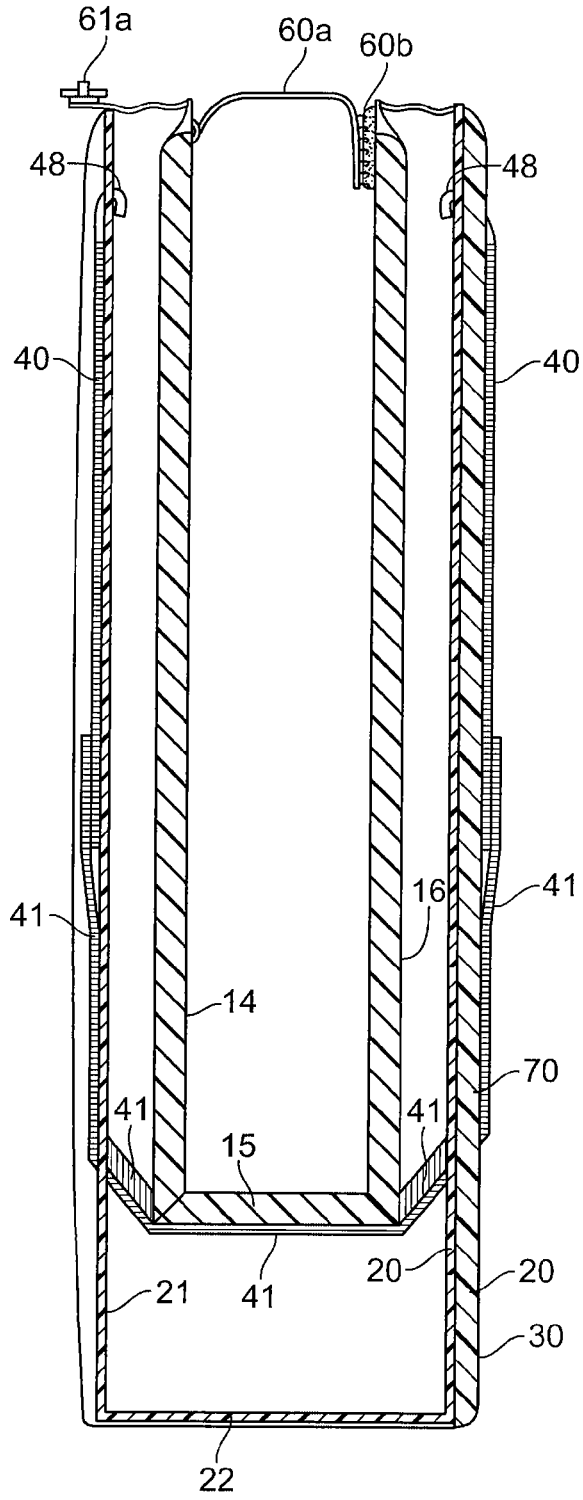
FIG. 3 is a sectional view of a carrying case with a compartment supported by a cross-brace system in accordance with the present invention as seen along the line 3-3 of FIG. 2.

The following description will be described with reference to FIGS. 1-3. FIG. 1 illustrates a computer (or other portable electronic device) compartment 10 in accordance with an embodiment of the present invention. FIG. 2 is a partial sectional view of a compartment supported by a cross-brace system in accordance with an embodiment of the present invention. FIG. 3 is a sectional view of a carrying case with a compartment supported by a cross-brace system in accordance with an embodiment of the present invention as seen along the line 3-3 of FIG. 2. Although embodiments of the present invention are described with respect to a computer compartment and a computer pouch, it will be understood that embodiments of the present invention may be used with devices other than computers, such as personal digital assistants (PDAs), cellular phones, pocket PCs, video game systems, etc.

Computer compartment 10 is preferably used with a computer bag, briefcase, or similar type carrying case 11; however, computer compartment 10 may be used without carrying case 11. Computer compartment 10 preferably includes a computer pouch 12 that is made up of soft material to protect the computer. A support structure 13 is provided that is made up of fairly rigid materials. Computer pouch 12 is preferably made up of a fabric outer material 14, such as nylon, surrounding some type of soft foam or cushion 15. Preferably, the interior material is some kind of soft cloth 16 to protect the surface of computer 17 (or other portable electronic device) placed therein. Those skilled in the art will understand that other appropriate materials or constructions may be utilized.

Support structure 13 is preferably made up of some type of rigid plastic, hard pressed wood, or other rigid, sturdy materials. Preferably support structure 13 includes at least two side walls 20, 21 and a bottom wall 22 coupling the two side walls. If desired, end walls may also be provided.

Computer pouch 12 is preferably coupled to support structure 13 with a fabric skirt 30. Preferably, pouch 12 is sewn to the fabric skirt and the fabric skirt is placed over the support structure. Zippers and/or hooks and loops and/or snaps or other types of connection devices may also be used to close, couple or "seal" the skirt around the support structure. Those skilled in the art will understand that other arrangements may be used to couple computer pouch 12 to support structure 13. Although pouch 12 is described as being sealed to support structure 13, it will be understood that pouch 12 may not be sealed to support structure 13. For example, pouch 12 may be removably sealed or not sealed at all.

Computer pouch 12 is supported within support structure 13. As may be seen in the Figures, in one embodiment, at least two straps 40, 41 are provided that are coupled to support structure 13 and traverse under computer pouch 12. Preferably, first strap 40 is coupled to an upper corner 42 of the support structure and passes diagonally along one wall 20 of support structure 13, passes through a grommet or hole 43 within the rigid support structure 13, traverses under computer pouch 12 and traverses diagonally along opposite wall 21, finally being coupled to an upper corner 44 of the opposite wall. Second strap 41 is coupled to second corner 45 of first wall 20, traverses diagonally along the first wall, passes through a grommet or a hole 46 defined within the rigid support structure 13, traverses under computer pouch 12 and then traverses diagonally along the opposite wall, finally being coupled to a top corner 47 of the opposite wall. The straps may be coupled in any suitable manner such as, for example, stitching, snaps, etc. In one embodiment, the straps are coupled to the walls with hooks 48 coupled to holes 49 defined within walls 20, 21. Preferably, as straps 40, 41 pass under computer pouch 12, they are coupled thereto with stitching or some other type of connection.

As may be seen in the Figures, some type of restraining device 60*a* may be provided. In this embodiment the device is illustrated as a strap of material that may be placed over a computer that is placed within the soft pouch. Strap 60*a* may be removably coupled to the compartment with hooks and loops at 60*b*. Other types of connections may be used if desired.

Once computer compartment 10 is assembled, it is placed within a computer bag, briefcase or similar carrying case 11. In a preferred embodiment, computer compartment 10 is coupled to carrying case 11 with at least one zipper 61*a*, 61*b*. Computer compartment 10 may have been removed from carrying case 11 by unzipping zippers 61*a*, 61*b*.

In another embodiment, computer compartment 10 may also be a removable sleeve and may not include zippers 61*a*, 61*b*. For example, computer compartment 10 may be adapted to slide into the carrying case 11. Computer compartment 10 may then be easily removed from the carrying case 11. Thus, if a user desires, computer compartment 10 may be used with other bags or carrying items.

Foam layer 70 or other soft material may be provided if desired along side 20, which faces other compartments or items within bag 11.

Thus, computer compartment 10 provides a soft, protective pouch for the computer that is placed within protective, rigid material. Computer pouch 12 is capable of movement with respect to support structure 13. Straps 40, 41 include some element of elastic to facilitate shock dampening movements. As shown, straps 40, 41 support a bottom side of computer pouch 12. Thus, straps 40, 41 act as a type of shock absorber in the event that carrying case 11, and thereby computer compartment 10, are dropped. The elasticity of straps 40, 41 allow computer pouch 12 to move when the computer compartment is dropped or is contacted by an object. Also, computer pouch 12 "floats" inside of support structure 13. As shown, space is provided between computer pouch 12 and support structure 13. This allows computer pouch 12 to move when carrying case 11 is impacted or moved. Accordingly, the shock of any impact is lessened because computer pouch 12 may move within support structure 13. Elastic straps 40, 41, however, also are strong enough to support computer pouch 12 such that movement of pouch 12 is limited during normal use. This provides extremely good protection for a computer within computer pouch 12.

In addition to providing shock dampening movements, support structure 13 is able to absorb impact when carrying case 11 is impacted. For example, a point of impact receives a large amount of energy from the shock of the impact. Thus, a point of impact on carrying case 11 may distribute a large amount of energy to a point on computer compartment 10. Conventionally, a computer is rigidly strapped into a carrying case and the shock is mainly absorbed at the point of impact. The shock is especially harmful when carrying case 11 is dropped and falls on a corner of case 11 or is not perfectly dropped on the spine of case 11.

Straps 40, 41 on support structure 13 serve to dissipate or transmit energy throughout support structure 13. For example, support structure 13 dissipates energy created on one side of the spine or corner to the other corner or sides of structure 13. By anchoring straps 40, 41 on one corner, traversing straps 40, 41 diagonally across and under support structure 13, and diagonally across the opposite side of support structure 13, impact on one corner or side is transmitted or dissipated to other parts of support structure 13. For example, the energy is dissipated to the other side or corner. Thus, the impact at a single point of carrying case 11 and a corresponding point of support structure 13 is lessened because the energy of the impact is dissipated throughout support structure 13. An electronic device being carried may be better protected because the force of an impact at a single point is lessened in lieu of distributing the force of the impact throughout support structure 13. The electronic device may not be able to withstand the energy of the large impact but may be able to withstand the energy of the impact if it is dissipated throughout the device. The goal of any protection system is to dissipate the kinetic energy that is a result of a mass (electronic device) moving at a certain speed (velocity at ground=0). By using angled supports, the energy is distributed between vertical and horizontal components. The configuration helps dissipate the kinetic energy that is present during a fall by dissipating the energy in two directions, vertical and horizontal. As the unit decelerates to a static position, the kinetic energy is dissipated in the shock absorption system.

In use, carrying case 11 may include computer compartment 10. A user may insert a computer into computer pouch 12. The computer is now supported in computer pouch 12 with straps 40, 41. As carrying case 11 is being carried, it may be dropped or banged around. When carrying case 11 is impacted, straps 40, 41 flex such that straps 40, 41 act as a shock absorbers. Also, straps 40, 41 brace support structure 13 such that energy from the impact at a point is dissipated throughout support structure 13. For example, the energy is dissipated to an opposing side or corner from the point. Accordingly, the computer is better protected while being carried in carrying case 11.

Carrying case 11 may also include a contoured panel 100. Preferably, contour panel 100 is made of a rigid plastic and thus, offers protection against hard, bulky or sharp accessories and other computer peripheral devices that are often carried within briefcases and computer bags. This helps prevent such devices from poking the user.

Thus, in use a person holds the bag such that contour panel 100 is against their body, preferably adjacent to their hip. The contour panel will "hug" the person's body due to its convex curvature, thereby moving the center of gravity of the bag closer to the center of gravity of the person. By moving the center of gravity of the bag closer to the center of the person carrying the bag, shoulder, back and neck fatigue and discomfort may be minimized. For example, the contour panel reduces weight impact by 35%. Contoured panel 100 is described in more detail in U.S. application Ser. No. 10/717215, filed Nov. 18, 2003, entitled "BAG INCLUDING A CONTOUR PANEL", which is hereby incorporated by reference in its entirety for all purposes.

In addition, a shock absorbing strap 102 may be coupled to carrying case 11. Strap 102 reduces shock to a user's shoulder when the carrying case 11 is jerked or moved. Strap 102 is described in more detail in U.S. application Ser. No. 10/717215, filed Nov. 18, 2003, entitled "BAG INCLUDING A CONTOUR PANEL", which is hereby incorporated by reference in its entirety for all purposes.

Embodiments of the present invention provide many advantages. For example, carrying case 11 is able to dampen the shock any impacts. Thus, electronic devices being carried may be less susceptible to damage. The shock may be dampened in many ways. For example, straps 40, 41 hold computer pouch 12 and limit its movement. Straps 40, 41, however, provide elastic support such that computer pouch 12 may move within support structure 13 upon impact. Thus, the shock of the impact is lessened because computer pouch 12 moves with the momentum of the impact. Also, straps 40, 41 form a cross brace structure that serves to dissipate energy from one side or corner of the bag to an opposing corner or side. This lessens the impact at a point of contact. Accordingly, a device being carried may be better protected by carrying case 11.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A compartment for a bag for carrying an item, the compartment comprising:

a main portion;

a second portion within the main portion; and a support arrangement that supports the second portion within the main portion and that allows limited movement of the second portion relative to the main portion wherein the support arrangement comprises two straps, a first strap extending from a first top corner on a first side of the main portion, and a second strap extending from a second top corner on the first side of the main portion, both the first and second straps extending under the second portion of the compartment to first and second top corners, respectively, on a second side of the main portion.

2. A compartment in accordance with claim 1 wherein the compartment is a computer pouch.

3. A compartment in accordance with claim 1 wherein the support arrangement is configured to distribute energy from an impact on the main portion from a first point on the main portion to a second point on the main portion.

4. A compartment in accordance with claim 3 wherein the first point comprises a corner of the main portion, wherein the second point comprises an opposite corner of the main portion.

5. A compartment in accordance with claim 3 wherein the first point comprises a side of the main portion, wherein the second point comprises an opposite side of the main portion.

6. A bag for carrying a portable electronic device, the bag comprising:

a main body; and a device compartment comprising:

a main portion;

a second portion within the main portion; and a support arrangement that supports the second portion within the main portion and that allows limited movement of the second portion relative to the main portion, wherein the support arrangement comprises two straps, a first strap extending from a first top corner on a first side of the main portion, and a second strap extending from a second top corner on the first side of the main portion, both the first and second straps extending under the second portion of the device compartment to first and second top corners, respectively, on a second side of the main portion.

7. A bag in accordance with claim 6 wherein the bag is for carrying notebook computers.

8. A bag in accordance with claim 6 wherein the straps are elastic or contain elastic segments.

9. A bag in accordance with claim 6 wherein the support arrangement is configured to distribute energy from an impact on the main portion from a first point on the main portion to a second point on the main portion.

10. A bag in accordance with claim 9 wherein the first point comprises a corner of the main portion, wherein the second point comprises an opposite corner of the main portion.

11. A bag in accordance with claim 9 wherein the first point comprises a side of the main portion, wherein the second point comprises an opposite side of the main portion.

12. A bag for carrying a portable electronic device, the bag comprising:

a main body;

a device compartment within the main body, the device compartment comprising a support structure consisting of a substantially rigid material and a soft pouch within the support structure; and a cross-brace support system that supports the soft pouch such that the soft pouch has limited movement relative to the support structure, wherein the cross-brace support system comprises two straps, a first strap extending from a first top corner on a first side of the support structure, and a second strap extending from a second top corner on the first side of the support structure, both the first and second straps extending under the soft pouch of the device compartment to first and second top corners, respectively, on a second side of the support structure.

13. A bag in accordance with claim 12 wherein the bag is for carrying notebook computers.

14. A bag in accordance with claim 12 wherein the straps are elastic or contain elastic segments.

15. A bag in accordance with claim 12 wherein the support system is configured to distribute energy from an impact on the support structure from a first point on the support structure to a second point in the support structure.

16. A bag in accordance with claim 15 wherein the first point comprises a corner of the support structure, wherein the second point comprises an opposite corner of the support structure.

17. A bag in accordance with claim 15 wherein the first point comprises a side of the support structure, wherein the second point comprises an opposite side.

18. A compartment for a bag for carrying an item, the compartment comprising:

a main portion;

a second portion within the main portion; and a support arrangement that supports the second portion within the main portion, wherein the support arrangement is configured to distribute energy from an impact on the main portion from a first point in the main portion to a second point on the main portion, wherein the support arrangement comprises two straps, a first strap extending from a first top corner on a first side of the main portion, and a second strap extending from a second top corner on the first side of the main portion, both the first and second straps extending under the second portion of the compartment to first and second top corners, respectively, on a second side of the main portion.

19. A compartment in accordance with claim 18 wherein the first point on the main portion comprises a corner of the main portion, wherein the second point comprises an opposite corner of the main portion.

20. A compartment in accordance with claim 18 wherein the support arrangement elastically suspends the second portion within the main portion.

21. A compartment in accordance with claim 18 wherein the second portion is formed with a soft material and the main portion is formed with a rigid material.

22. A compartment in accordance with claim 18 wherein the compartment is adapted to be removably inserted into bag.

23. A compartment in accordance with claim 18 wherein the item comprises a portable electronic device.

24. A method of using a bag, the method comprising:

providing a compartment for the bag, the compartment comprising a main portion; a second portion within the main portion; and a support arrangement that supports the second portion within the main portion; and receiving a portable electronic device in the second portion of the compartment, wherein the support arrangement is configured to distribute energy from an impact on the main portion from a first point in the main portion to a second point on the main portion when the bag is impacted, wherein the support arrangement comprises two straps, a first strap extending from a first top corner on a first side of the main portion, and a second strap extending from a second top corner on the first side of the main portion, both the first and second straps extending under the second portion of the compartment to first and second top corners, respectively, on a second side of the main portion.

25. The method of claim 24 wherein the support arrangement elastically suspends the second portion within the main portion.

26. The method of claim 24 further comprising removing the compartment from the bag.

27. The method of claim 24 wherein the portable electronic device comprises a notebook computer.

* * * * *